US007956811B2

(12) United States Patent
Huang

(10) Patent No.: US 7,956,811 B2
(45) Date of Patent: Jun. 7, 2011

(54) ANTENNA AND ANTENNA SET WITH LOWER HEIGHT

(75) Inventor: Chi-Cheng Huang, Taoyuan County (TW)

(73) Assignee: Delta Networks, Inc., Taipei (TW)

( * ) Notice: Subject to any disclaimer, the term of this patent is extended or adjusted under 35 U.S.C. 154(b) by 334 days.

(21) Appl. No.: 12/166,086

(22) Filed: Jul. 1, 2008

(65) Prior Publication Data

US 2009/0262025 A1 Oct. 22, 2009

(30) Foreign Application Priority Data

Apr. 18, 2008 (TW) ..... 97114257 A

(51) Int. Cl.
*H01Q 1/38* (2006.01)

(52) U.S. Cl. ..... 343/700 MS; 343/702

(58) Field of Classification Search ..... 343/700 MS, 343/846, 702, 848
See application file for complete search history.

(56) References Cited

U.S. PATENT DOCUMENTS

| | | | | |
|---|---|---|---|---|
| 6,008,764 | A * | 12/1999 | Ollikainen et al. | 343/700 MS |
| 6,977,616 | B2 * | 12/2005 | Yuanzhu | 343/700 MS |
| 6,995,720 | B2 * | 2/2006 | Shikata | 343/702 |
| 2005/0052323 | A1 * | 3/2005 | Shikata | 343/700 MS |
| 2005/0057400 | A1 * | 3/2005 | Yuanzhu | 343/700 MS |
| 2007/0257843 | A1 * | 11/2007 | Gooshchin | 343/700 MS |

* cited by examiner

*Primary Examiner* — HoangAnh T Le
(74) *Attorney, Agent, or Firm* — J.C. Patents

(57) ABSTRACT

An antenna and an antenna set are provided. The antenna is composed of a horseshoe sheet member and two rectangular sheet members. The horseshoe sheet member and the two rectangular sheet members are all made of a metal material. The antenna is made of a metal material, such as tinplate, and the antenna is adapted for receiving or emitting wireless signals of vertical polarization and horizontal polarization. The antenna set includes three antennae as above disposed on a substrate. The antenna set is adapted for polarization diversity, pattern diversity, and space diversity. Comparing with the conventional antenna and antenna set, the antenna and the antenna set according to the present invention have lower costs and lower heights, and can be designed as embedded antennae or hidden antennae.

10 Claims, 12 Drawing Sheets

ANTENNA AND ANTENNA SET WITH LOWER HEIGHT

CROSS-REFERENCE TO RELATED APPLICATION

This application claims the priority benefit of Taiwan application serial no. 97114257, filed on Apr. 18, 2008. The entirety of the above-mentioned patent application is hereby incorporated by reference herein and made a part of this specification.

BACKGROUND OF THE INVENTION

1. Field of the Invention

The present invention generally relates to an antenna and an antenna set, and more particularly, to an antenna and an antenna set adapted for a wireless communication system.

2. Description of Related Art

Currently, people's communication technology has been developed into a new era of wireless communication, in which there are a variety of wireless communication apparatuses developed correspondingly. An antenna is critical component for a wireless communication apparatus which and necessary for receiving signals from a wireless channel. As such, the design of antenna is always an important subject concerned by many research institutes and enterprises in the art.

When a wireless signal is transmitted in the air, a direction of an electric field thereof is usually divided into vertical polarization and horizontal polarization. When the direction of the electric field is perpendicular to the ground plane, the wireless signal is identified as vertical polarized, and when the direction of the electric field is parallel with the ground plane, the wireless signal is identified as horizontal polarized. When a received antenna and an emitted antenna correspond to cross polarization directions, a signal loss will be caused thereby. As such, the received antenna and the emitted antenna must be designed corresponding to a same polarization direction.

The polarization direction of a client end antenna can be either vertical polarization or horizontal polarization. As such, an ordinary wireless fidelity (Wi-Fi) router typically employs a monopole antenna, and configures a movable joint at a terminal thereof. When a base of the monopole antenna is fixed, the monopole antenna can be disposed either vertically or horizontally by adjusting the movable joint. When the monopole antenna is vertically disposed, the polarization direction is vertical polarization, and when the monopole antenna is horizontally disposed, the polarization direction is horizontal polarization. Such an external monopole antenna has the disadvantages of a higher cost, a higher height, and is incapable of being integrated in the wireless product, so that it cannot be designed as an embedded antenna or a hidden antenna.

SUMMARY OF THE INVENTION

Accordingly, the present invention is directed to an antenna, for receiving and emitting wireless signals of a vertical polarization direction and a horizontal polarization direction.

Further, the present invention is further directed to an antenna set, for receiving or emitting wireless signals of a vertical polarization direction and a horizontal polarization direction. The antenna set includes three antennae disposed on a substrate, having characteristics of polarization diversity, pattern diversity, and space diversity.

The present invention provides an antenna. The antenna includes a first rectangular sheet member, a horseshoe sheet member, and a second rectangular sheet member, all of which are made of metal materials. The horseshoe sheet member has an opening end configured with two branches. One of the two branches is connected with the first rectangular sheet member. A plane where the horseshoe sheet member is located is substantially perpendicular with a plane where the first rectangular sheet member is located. A top of the second rectangular sheet member is connected with the first rectangular sheet member. A direction extending from a bottom side of the second rectangular sheet member to the top of the second rectangular sheet member is substantially equivalent with a direction of the opening of the horseshoe sheet member. A plane where the second rectangular sheet member is located is substantially perpendicular with the plane where the first rectangular sheet member is located, and is substantially parallel with the plane where the horseshoe sheet member is located.

According to an embodiment of the present invention, the antenna has a first resonant frequency, and a second resonant frequency. The antenna is adapted for obtaining a wider frequency bandwidth channel in accordance with resonant frequency ranges of the first resonant frequency and the second resonant frequency, and receiving or emitting signals in such a frequency bandwidth channel.

According to an embodiment of the present invention, the horseshoe sheet member is composed of a third rectangular sheet member, a fourth rectangular sheet member, and a fifth rectangular sheet member, and the third, fourth and fifth rectangular sheet members are connected together. The third and the fifth rectangular sheet members configure the two branches of the horseshoe sheet member, respectively. The fifth rectangular sheet member is connected to the first rectangular sheet member, and the fourth rectangular sheet member is connected between the third rectangular sheet member and the fifth rectangular sheet member. Lengths of the second, the third, the fourth, and the fifth rectangular sheet members are correspondingly related to the first resonant frequency, and lengths of the first, the second, and the fifth rectangular sheet members are correspondingly related to the second resonant frequency.

The present invention further provides an antenna set including three antennae and a substrate. Each of the three antennae includes a first rectangular sheet member, a horseshoe sheet member, and a second rectangular sheet member, all of which are made of metal materials. The horseshoe sheet member has an opening end and a closing end. The opening end is configured with two branches. One of the two branches is connected with the first rectangular sheet member. The closing end is configured with a signal connection terminal. A plane where the horseshoe sheet member is located is substantially perpendicular with a plane where the first rectangular sheet member is located. The second rectangular sheet member has a top and a bottom side. The top of the second rectangular sheet member is connected with the first rectangular sheet member. The bottom side of the second rectangular sheet member is configured with a ground connection terminal. A direction extending from the bottom side to the top of the second rectangular sheet member is substantially equivalent with a direction of the opening of the horseshoe sheet member. A plane where the second rectangular sheet member is located is substantially perpendicular with the plane where the first rectangular sheet member is located, and is substantially parallel with the plane where the horseshoe sheet member is located. All of the three antennae are disposed on the substrate. The plane where the horseshoe sheet member of the first antenna is located is substantially perpendicular with the plane where the horseshoe sheet member of the third antenna is located. The plane where the horseshoe sheet member of the second antenna is located substantially configures an angle of 45° with the plane where the horseshoe sheet member of the first antenna is located.

According to an embodiment of the present invention, the first and the third antennae are received antennae, and the second antenna is an emitted antenna.

According to an embodiment of the present invention, the substrate includes three microstrip lines allowing wireless signals to be fed in the antennae, and the three microstrip lines are coupled to the three signal connection terminals. The ground connection terminal of each of the second rectangular sheet members of the antennae is connected to a ground.

According to an embodiment of the present invention, each of the antennae has a first resonant frequency, and a second resonant frequency, so that the antenna is adapted for obtaining a wider frequency bandwidth channel in accordance with resonant frequency ranges of the first resonant frequency and the second resonant frequency, and receiving or emitting signals in such a frequency bandwidth channel.

According to an embodiment of the present invention, each horseshoe sheet member of the antennae is composed of a third rectangular sheet member, a fourth rectangular sheet member, and a fifth rectangular sheet member, and the third, fourth and fifth rectangular sheet members are connected together. The third and the fifth rectangular sheet members configure the two branches of the horseshoe sheet member, respectively. The fifth rectangular sheet member is connected to the first rectangular sheet member, and the fourth rectangular sheet member is connected between the third rectangular sheet member and the fifth rectangular sheet member. Lengths of the second, the third, the fourth, and the fifth rectangular sheet members are correspondingly related to the first resonant frequency, and lengths of the first, the second, and the fifth rectangular sheet members are correspondingly related to the second resonant frequency.

The antenna according to the embodiment of the present invention, employs a horseshoe configuration, and therefore is adapted to emit or receive wireless signals of vertical polarization direction and horizontal polarization direction. Such an antenna has a lower height than the conventional antenna, and can be made of tinplate which is cheap. Further, the antenna set provided by the embodiment of the present invention employs three antennae disposed on a substrate, having characteristics of polarization diversity, pattern diversity, and space diversity. As such, the antenna set can have a better performance, a lower cost, and lower antennae heights than the conventional antenna set.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
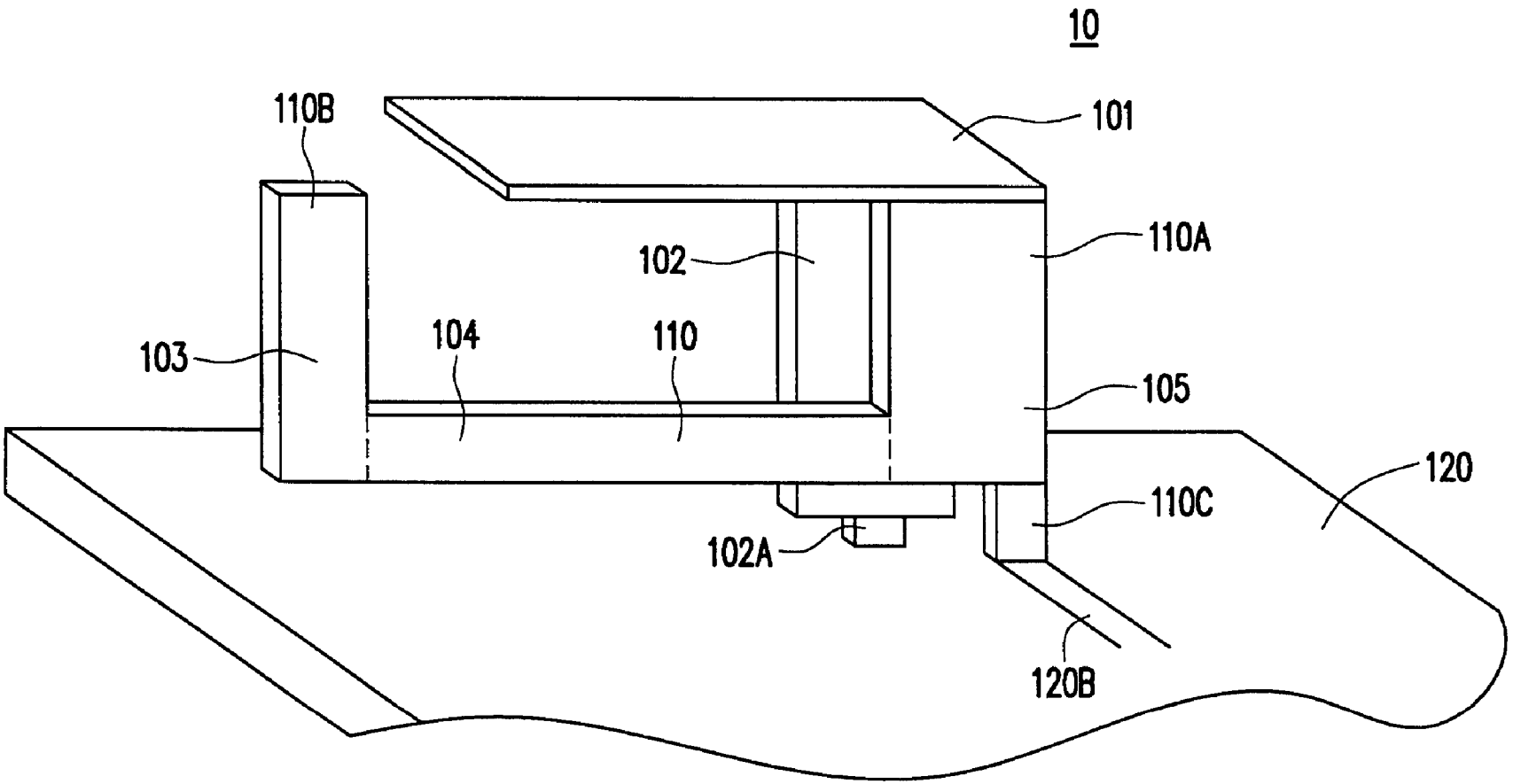
FIG. 1A is a solid structural view of an antenna 10 according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The present invention provides an antenna and an antenna set, adapted for simultaneously receiving or emitting wireless signals in a vertical polarization direction and a horizontal polarization direction. Embodiments of the present invention are going to be discussed below in details without restricting the scope of the present invention.

Figure 1B:
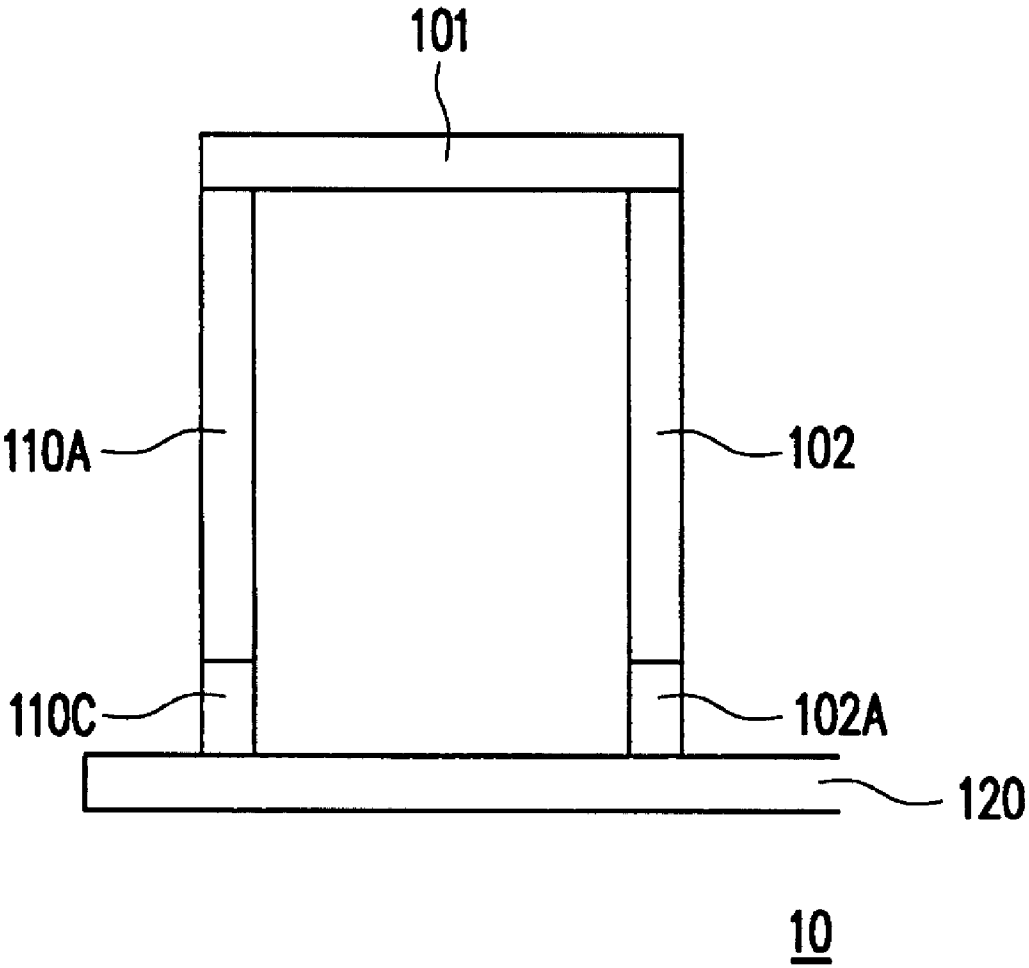
FIG. 1B is a side view of the antenna 10.

FIG. 1A is a solid structural view of an antenna 10 according to an embodiment of the present invention. FIG. 1B is a side view of the antenna 10. Referring to FIGS. 1A and 1B, the antenna 10 includes a first rectangular sheet member 101, a horseshoe sheet member 110, a second rectangular sheet member 102 and a substrate 120. The first rectangular sheet member 101, the horseshoe sheet member 110, and the second rectangular sheet member 102 are all made of metal materials, such as tinplate or copper or the like. The substrate 120 is made of a glass fiber material, such as flame retardant 4 (Fr4).

The horseshoe sheet member 110 has an opening end configured with two branches 110A and 110B. A branch 110A is connected to the first rectangular sheet member 101. A plane where the horseshoe sheet member 110 is located is substantially perpendicular with a plane where the first rectangular sheet member 101 is located. A top side of the second rectangular sheet member 102 is connected with the first rectangular sheet member 101. A direction extending from a bottom side of the second rectangular sheet member 102 to the top of the second rectangular sheet member 102 is substantially equivalent with a direction of the opening of the horseshoe sheet member 110. A plane where the second rectangular sheet member 102 is located is substantially perpendicular with the plane where the first rectangular sheet member 101 is located, and is substantially parallel with the plane where the horseshoe sheet member 110 is located.

Referring to FIG. 1B, it is preferred in the embodiment, that the branch 110A of the opening end of the horseshoe sheet member 110 is connected with one side edge of the first rectangular sheet member 101, and the second rectangular sheet member 102 is connected with another side edge of the first rectangular sheet member 101. However, it should be noted that the above preferred connection is not for restricting the scope of the present invention.

Referring to FIGS. 1A and 1B, the horseshoe sheet member 110 further has a closing end. The closing end includes a signal connection terminal 110C. The bottom side of the second rectangular sheet member 102 includes a ground connection terminal 102A. The substrate 120 includes a microstrip line for feeding in a signal. The ground connection terminal 102A is connected to a ground.

The horseshoe sheet member 110 is composed of a third rectangular sheet member 103, a fourth rectangular sheet member 104, and a fifth rectangular sheet member 105, and the third, fourth and fifth rectangular sheet members 103, 104, 105 are connected together. The third rectangular sheet member 103 and the fifth rectangular sheet member 105 configure the two branches 110B and 110A of the horseshoe sheet member 110, respectively. The fifth rectangular sheet member 105 is connected to the first rectangular sheet member 101, and the fourth rectangular sheet member 104 is connected between the third rectangular sheet member 103 and the fifth rectangular sheet member 105.

The antenna 10 has a structure configured at both the vertical direction and the horizontal direction, and therefore is adapted for receiving or emitting wireless signals of the vertical polarization direction and the horizontal polarization direction. Further, the antenna 10 has a first resonant frequency and a second resonant frequency. Taking advantages of resonant frequency ranges of the first resonant frequency and the second resonant frequency, the antenna 10 achieves a wider frequency bandwidth than usual, and is thus capable of receiving or emitting wireless signals in a channel of such a frequency bandwidth. Lengths of the second rectangular sheet member 102, the third rectangular sheet member 103, the fourth rectangular sheet member 104, and the fifth rectangular sheet member 105 are correspondingly related to the first resonant frequency, and lengths of the first rectangular sheet member 101, the second rectangular sheet member 102, and the fifth rectangular sheet member 105 are correspondingly related to the second resonant frequency.

Figure 2:
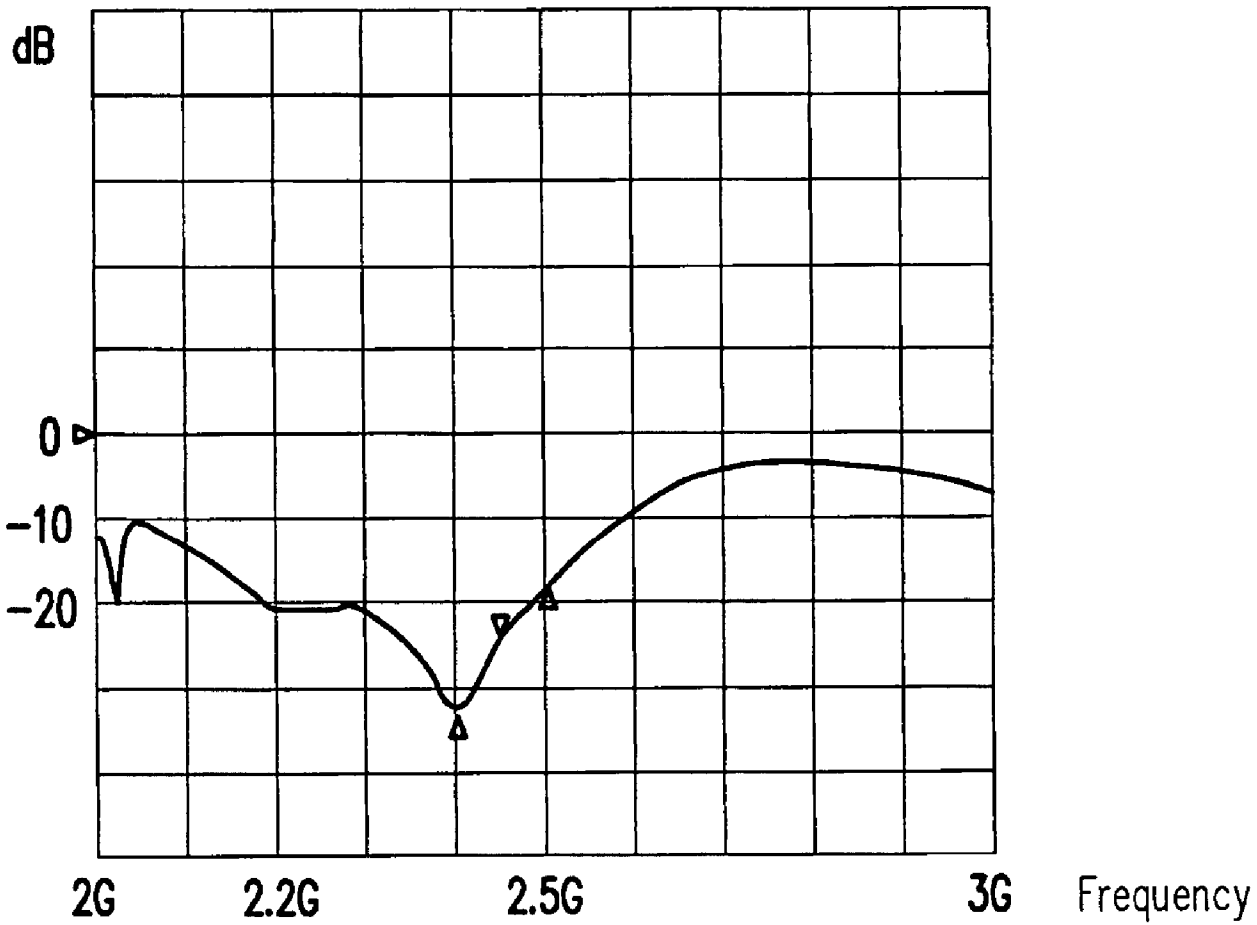
FIG. 2 is a reflectivity-frequency curve of the antenna 10.

Referring to FIG. 2, it shows a reflectivity-frequency curve of the antenna 10. As shown in FIG. 2, the first resonant frequency is about 2.2 GHz, and the second resonant frequency is about 2.5 GHz. As such, the antenna 10 has a frequency bandwidth of about 300 MHz. In the embodiment of FIG. 2, the first resonant frequency is defined to be about 2.2 GHz by designing the lengths of the second rectangular sheet member 102, the third rectangular sheet member 103, the fourth rectangular sheet member 104, and the fifth rectangular sheet member 105, and the second resonant frequency is defined to be about 2.5 GHz by designing the lengths of the first rectangular sheet member 101, the second rectangular sheet member 102, and the fifth rectangular sheet member 105.

Figure 3A:
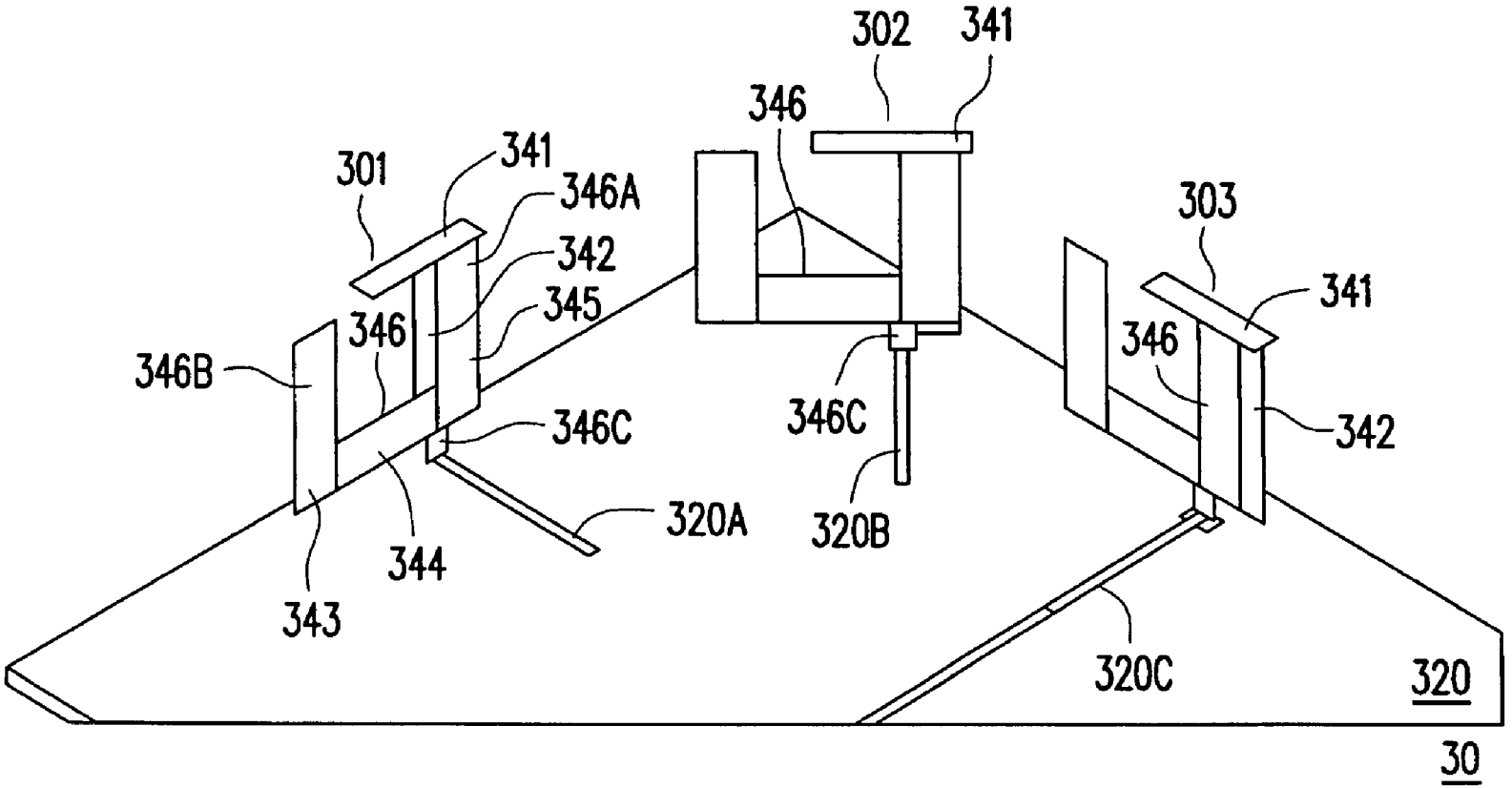
FIG. 3A is a solid structural view of an antenna set 30 according to an embodiment of the present invention.
Figure 3B:
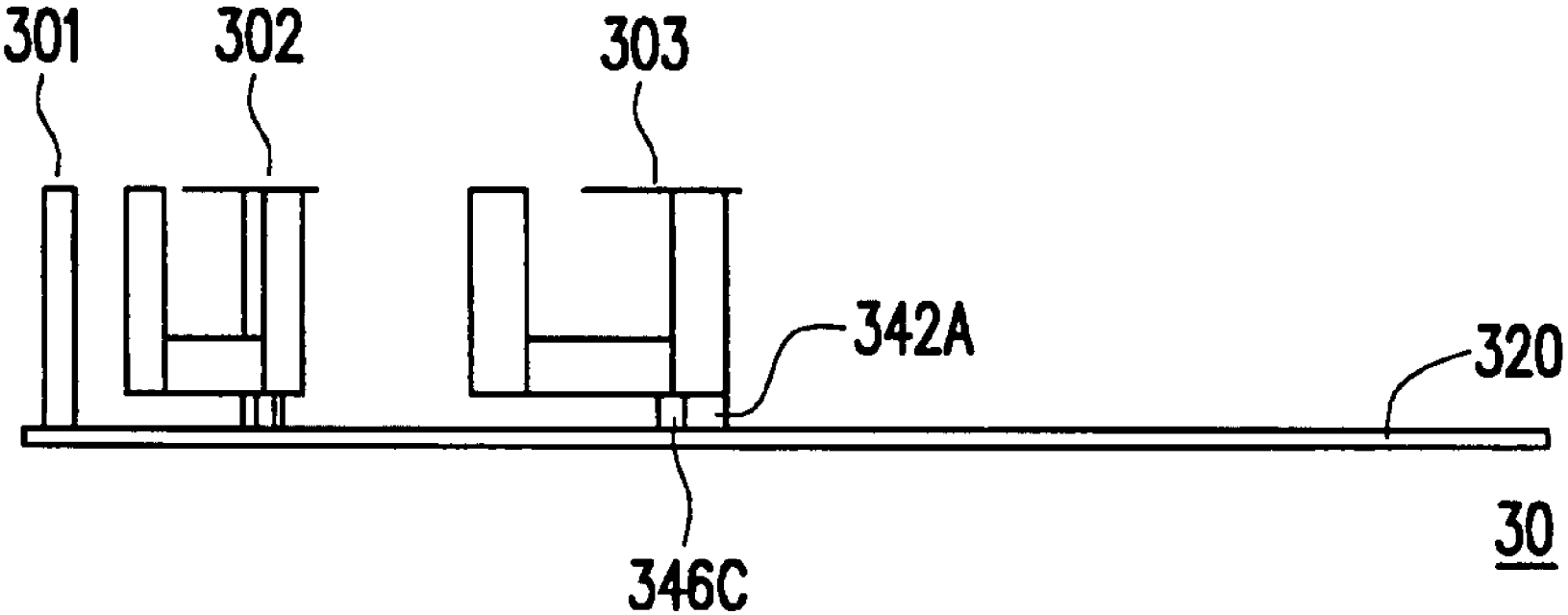
FIG. 3B is a side view of the antenna set 30.

FIG. 3A is a solid structural view of an antenna set 30 according to an embodiment of the present invention. FIG. 3B is a side view of the antenna set 30. Referring to FIGS. 3A and 3B, the antenna set 30 includes three antennae 301, 302, 303, and a substrate 320. The antennae 301, 302, 303 are structurally identical one to another. The antenna 301 is taken as an example for illustrating the antennae 301, 302, 303. The antenna 301 includes a first rectangular sheet member 341, a horseshoe sheet member 346, and a second rectangular sheet member 342, all of which are made of metal materials, such as tinplate or copper.

The horseshoe sheet member 346 has an opening end and a closing end. The opening end is configured with two branches 346A and 346B. One branch 346A is connected with the first rectangular sheet member 341. The closing end includes a signal connection terminal 346C. A plane where the horseshoe sheet member 346 is located is substantially perpendicular with a plane where the first rectangular sheet member 341 is located. The second rectangular sheet member 342 has a top and a bottom side. The top of the second rectangular sheet member 342 is connected with the first rectangular sheet member 341. The bottom side of the second rectangular sheet member 342 includes a ground connection terminal 342A (sheltered and invisible in FIG. 3A). A direction extending from the bottom side to the top of the second rectangular sheet member 342 is substantially equivalent with a direction of the opening of the horseshoe sheet member 346. A plane where the second rectangular sheet member 342 is located is substantially perpendicular with the plane where the first rectangular sheet member 341 is located, and is substantially parallel with the plane where the horseshoe sheet member 346 is located.

The substrate 320 is made of a glass fiber material, i.e., flame retardant 4 (Fr4). The substrate 320 includes three microstrip lines 320A, 320B, 320C, for allowing wireless signals to be fed in the antennae. The three microstrip lines 320A, 320B, 320C are connected with three signals connection terminals 346C of the three antennae 301, 302, 303, respectively. The ground connection terminal 342A of each of the antennae 301, 302, 303 is connected to a ground.

The plane where the horseshoe sheet member 346 of the first antenna 301 is located is substantially perpendicular with the plane where the horseshoe sheet member 346 of the third antenna is located 303. The plane where the horseshoe sheet member 346 of the second antenna 302 is located substantially configures an angle of 45° with the plane where the horseshoe sheet member 346 of the first antenna 301 is located.

According to the embodiment, it is preferred that the branch 346A of the opening end of the horseshoe sheet member 346 is connected with one side edge of the first rectangular sheet member 341, and the second rectangular sheet member 342 is connected with another side edge of the first rectangular sheet member 341. However, it should be noted that the above preferred connection is not for restricting the scope of the present invention.

Further, the horseshoe sheet member 346 is composed of a third rectangular sheet member 343, a fourth rectangular sheet member 344, and a fifth rectangular sheet member 345, and the third, fourth, and fifth rectangular sheet member 343, 344, 345 are connected together. The third rectangular sheet member 343 and the fifth rectangular sheet member 345 configure the two branches 346B and 346A of the horseshoe sheet member 346, respectively. The fifth rectangular sheet member 345 is connected to the first rectangular sheet member 341, and the fourth rectangular sheet member 344 is connected between the third rectangular sheet member 343 and the fifth rectangular sheet member 345.

According to the embodiment, the first antenna 301 and the third antenna 303 are received antennae, and the second antenna 302 is an emitted antenna. The antennae 301, 302, 303 are featured as the antenna 10 of FIG. 1A. In the current embodiment, it is preferred to provide a first resonant frequency and a second resonant frequency as that of FIG. 2, so as to allow the antenna set 30 to achieve a 300 MHz frequency bandwidth.

Figure 4:
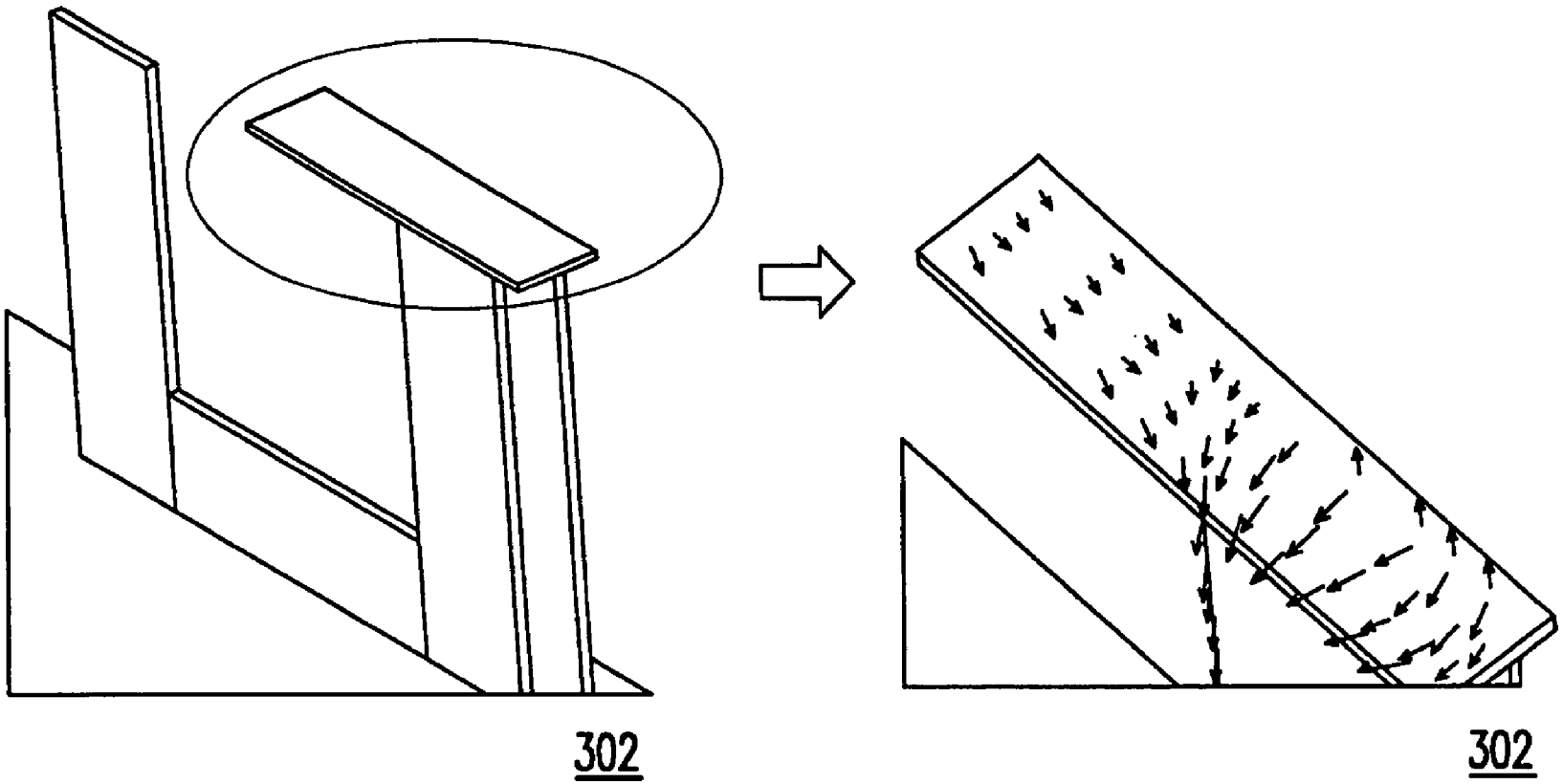
FIG. 4 is a schematic diagram illustrating a current direction of a horizontal current in a second antenna 302.
Figure 5A:
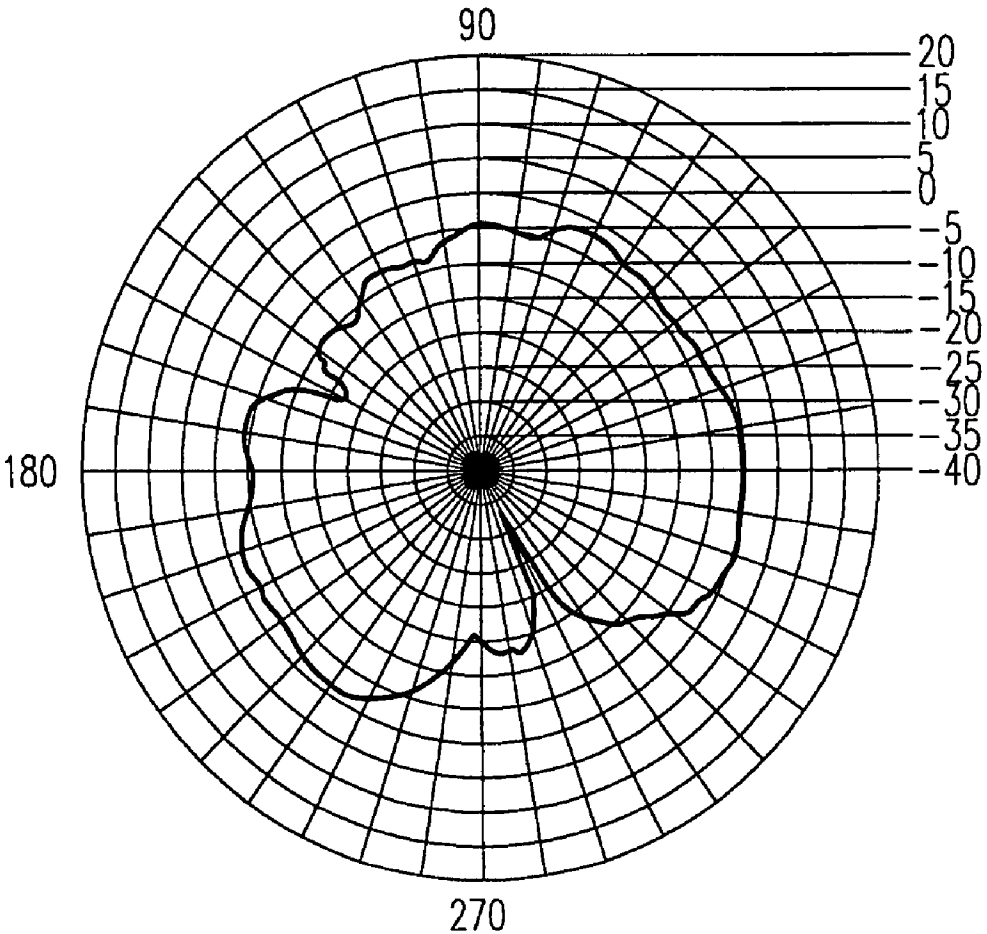
FIG. 5A is a pattern measurement diagram of a horizontal polarization of the second antenna 302.

FIG. 4 is a schematic diagram illustrating a current direction of a horizontal current in the second antenna 302. Referring to FIG. 4, a horizontal polarization gain can be adjusted by adjusting the length of the first rectangular sheet member 341 of the second antenna 302. The current direction of the horizontal current in the second antenna 302 shown in FIG. 4 can be achieved by adjusting the horizontal polarization gain. FIG. 5A is a pattern measurement diagram of a horizontal polarization of the second antenna 302. As shown in FIG. 5A, the maximum gain of the horizontal polarization is 0.71 dBi.

Figure 5B:
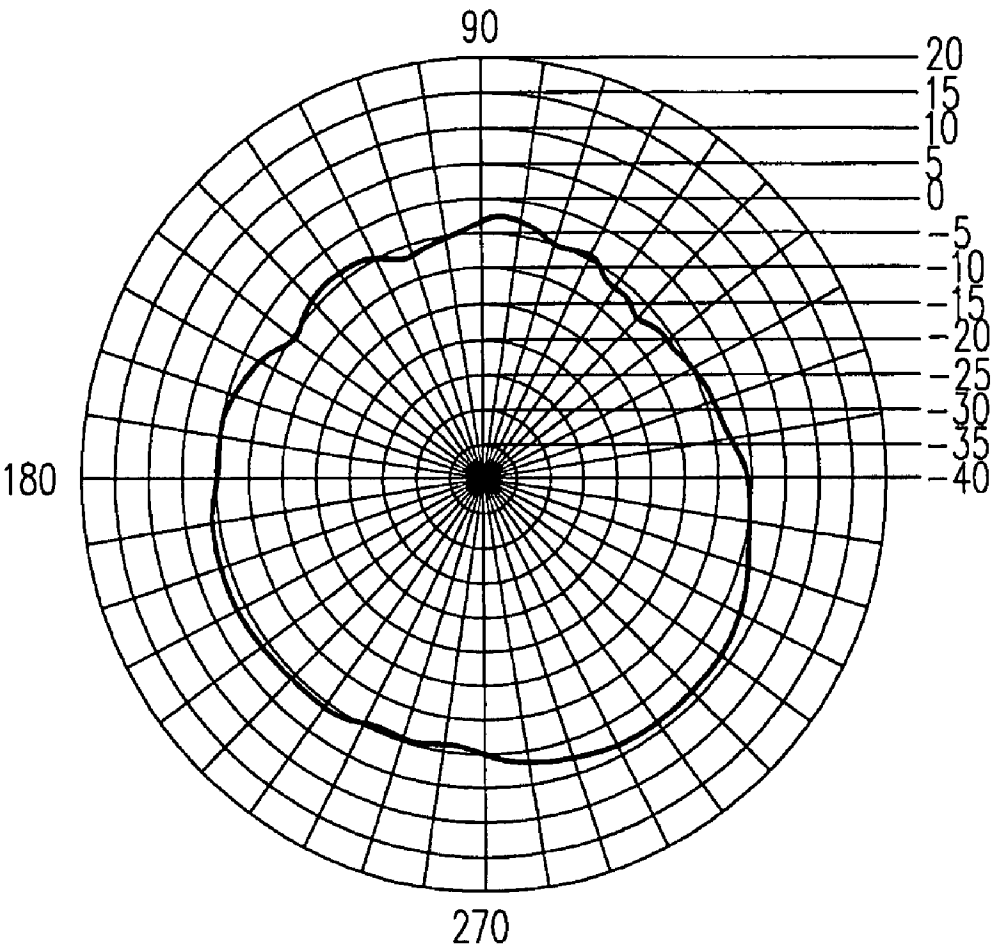
FIG. 5B is a pattern measurement diagram of a vertical polarization of the second antenna 302.

In order to increase a vertical polarization gain of the antenna 302, heights of the second rectangular sheet member 342, the third rectangular sheet member 343, and the fifth rectangular sheet member 345 should be increased. The vertical electric field is increased as the increased heights of that, so that the vertical polarization gain can also be increased. FIG. 5B is a pattern measurement diagram of a vertical polarization of the second antenna 302. Referring to FIG. 5B, a maximum gain as shown in FIG. 5B which is 3.4 dBi hereby, can be achieved by designing the heights of the second rectangular sheet member 342, the third rectangular sheet member 343, and the fifth rectangular sheet member 345.

A horizontal polarization antenna is incapable of receiving a vertical polarization wave. As such, it is conventional to provide a vertical polarization antenna and a horizontal polarization antenna, and switch between the vertical polarization antenna and the horizontal polarization antenna with an electronic switch, so as to control the antenna of a same polarization direction with the signals transmitted thereby. However, on the contrary, the antenna set 30 is composed of a multiple of antennae 301 through 303 which are capable of receiving or emitting a dual polarization wave having both a horizontal polarization and a vertical polarization. As such, the antenna set 30 according to the embodiment of the present invention is adapted for polarization diversity.

Generally, an antenna often achieves a greater gain at a certain angle. As such, two or more antennae are often employed for compensating the angles corresponding to weaker signals. The two or more antennae are usually disposed to configure a 90° angle therebetween. An electronic switch is used to fast switch between the antennae, and when the weaker one corresponding to the signals is detected by comparison, the stronger one corresponding to the signals is maintained in operation.

Figure 6A:
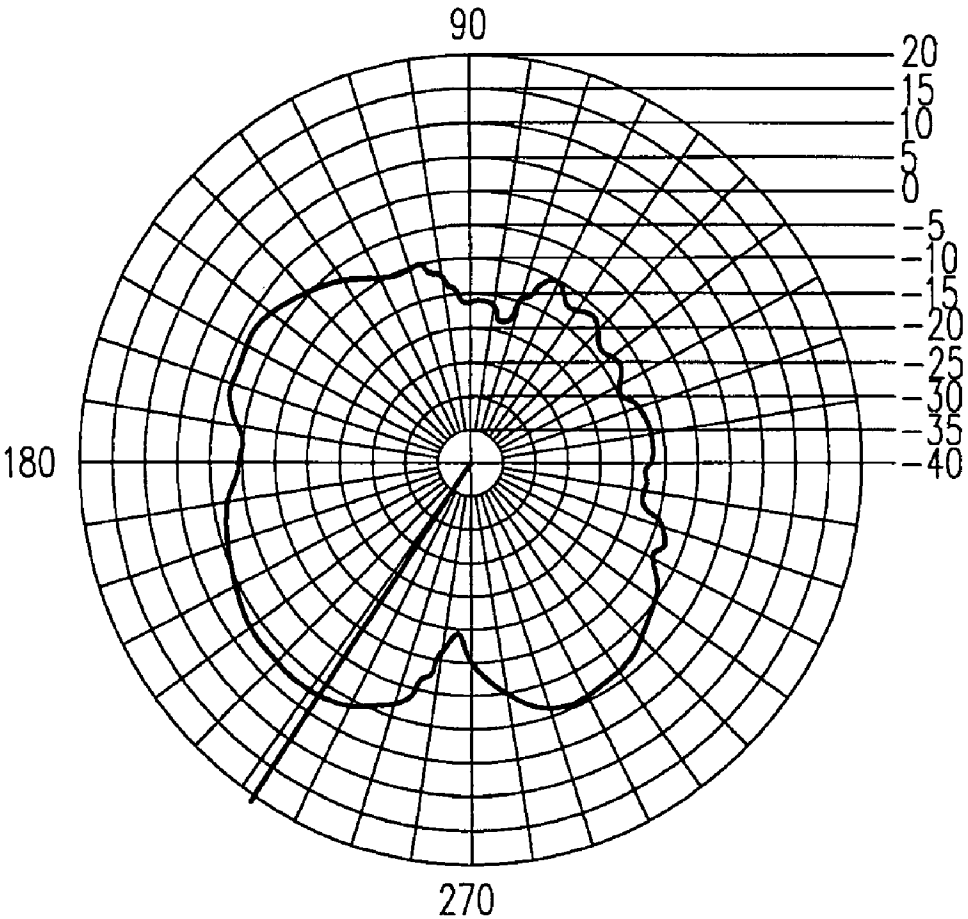
FIG. 6A is a pattern measurement diagram of a horizontal polarization of a first antenna 301.
Figure 6B:
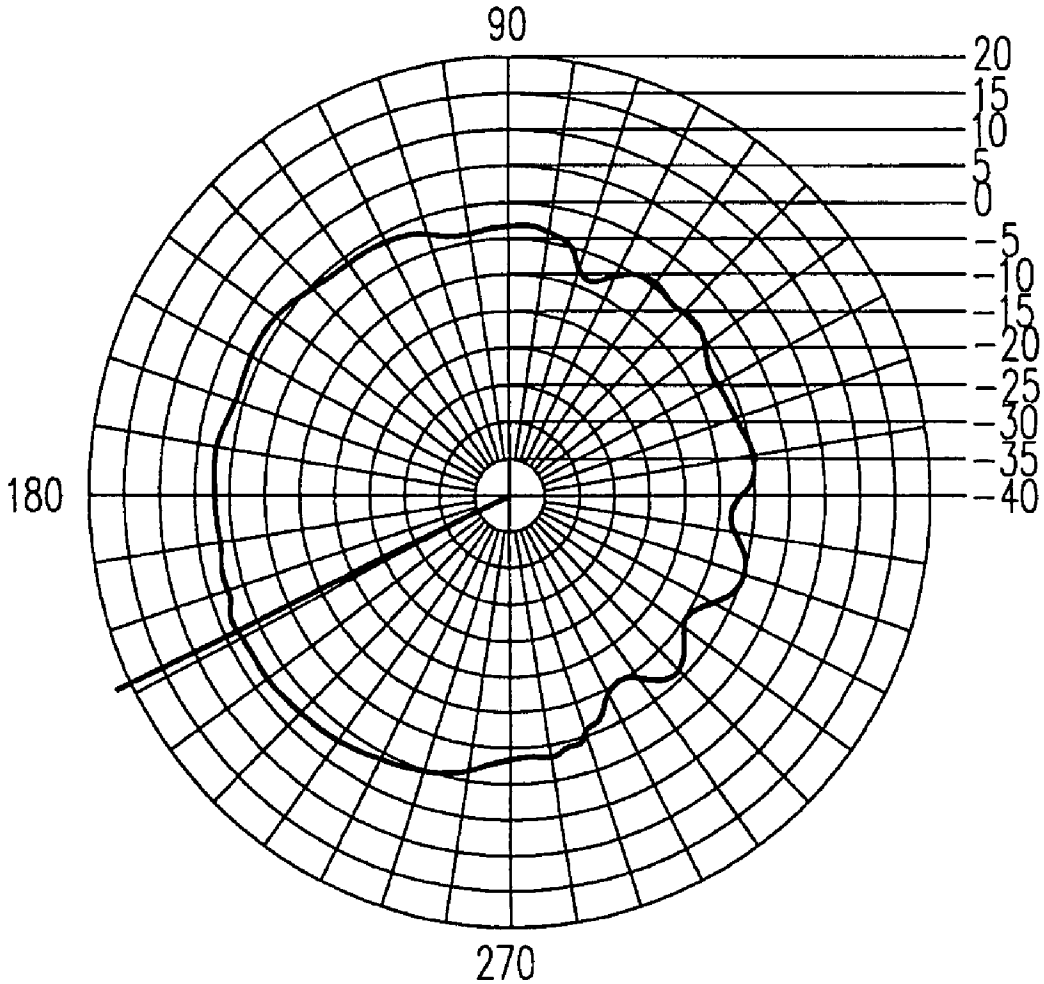
FIG. 6B is a pattern measurement diagram of a vertical polarization of the first antenna 301.
Figure 7A:
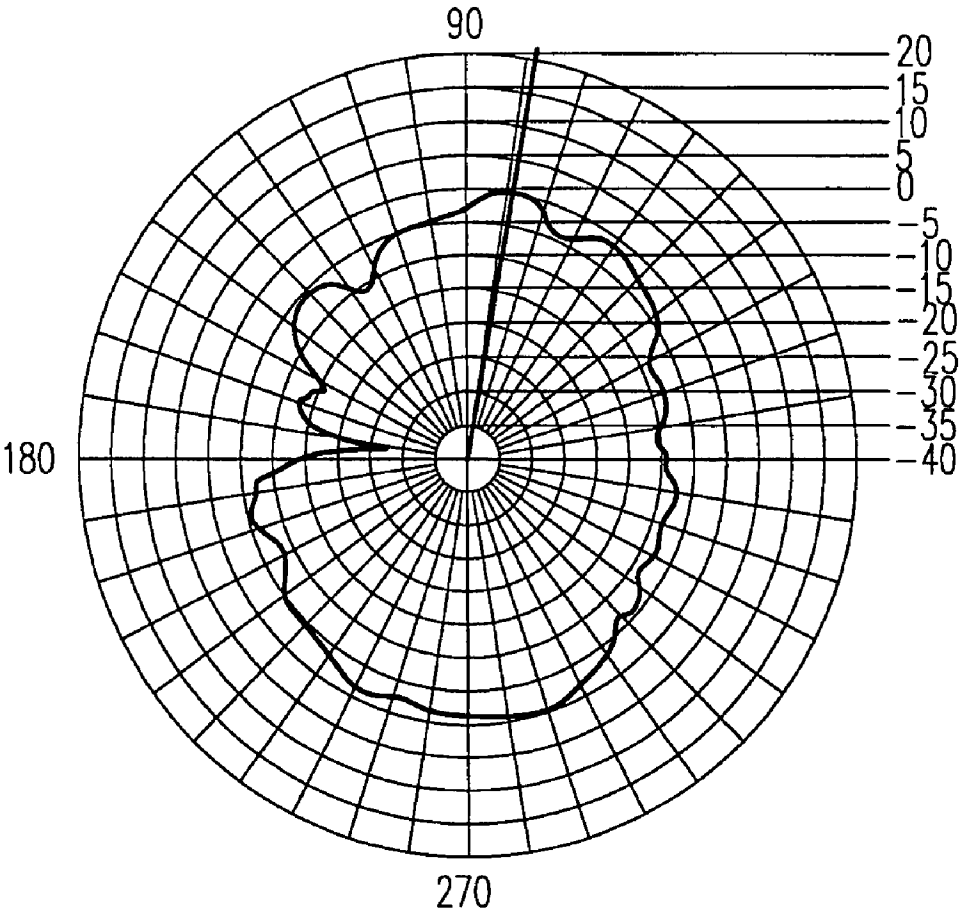
FIG. 7A is a pattern measurement diagram of a horizontal polarization of a third antenna 303.
Figure 7B:
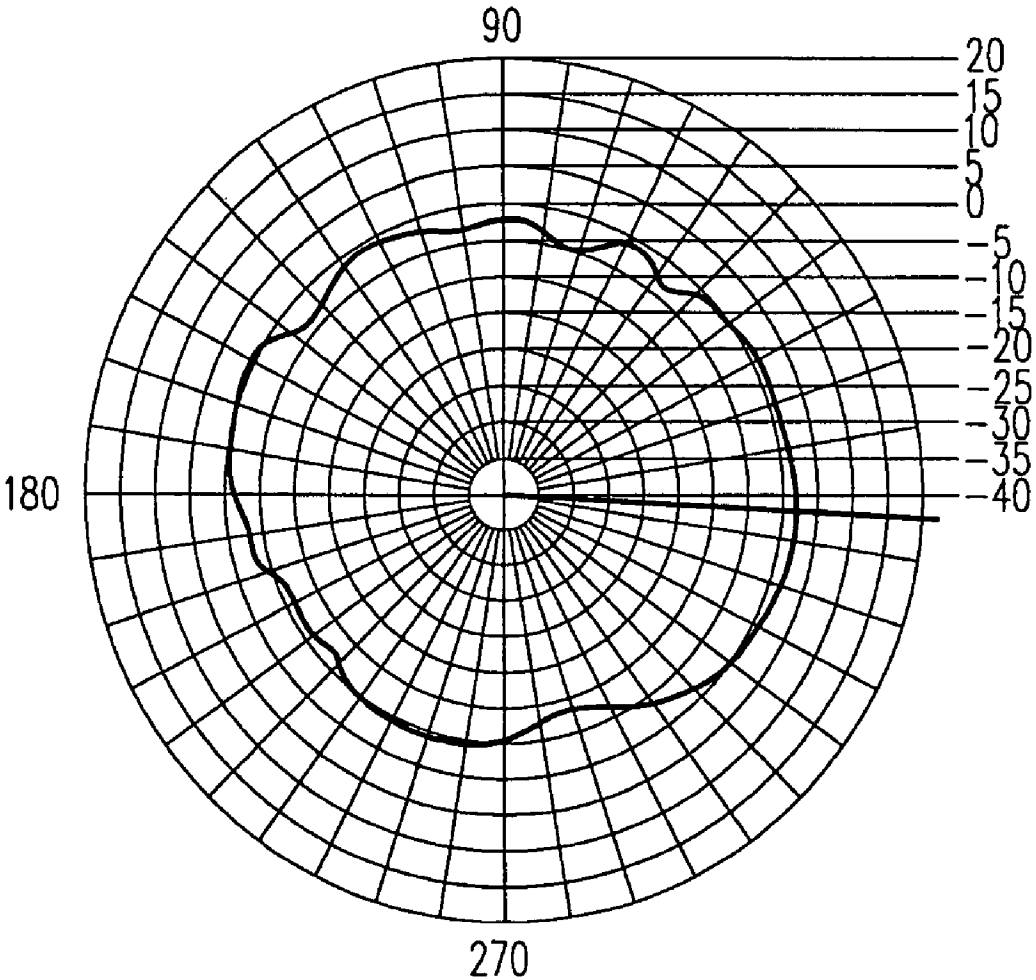
FIG. 7B is a pattern measurement diagram of a vertical polarization of the third antenna 303.

FIG. 6A is a pattern measurement diagram of a horizontal polarization of a first antenna 301. FIG. 6B is a pattern measurement diagram of a vertical polarization of the first antenna 301. FIG. 7A is a pattern measurement diagram of a horizontal polarization of a third antenna 303. FIG. 7B is a pattern measurement diagram of a vertical polarization of the third antenna 303. Referring to FIGS. 6A through 7B, the antenna set 30 employs two antennae 301 and 302 for receiving signals. The antennae 301 and 302 gain at different directions, and accordingly, the foregoing method can be used for the antenna set 30 to achieve a pattern diversity.

Further, the antennae 301 and 302 are located at different positions. Therefore, after detecting the one corresponding to the weaker signals by comparison, the antenna set 30 can achieve a space diversity by controlling to use the stronger one corresponding to the signals.

The antenna set 30 can be used in a WiFi wireless network card communication system. The antenna set 30 is capable of receiving a dual polarization wave having a Vertical polarization and a horizontal polarization, and therefore no matter the emitted antenna is a horizontal polarization antenna or a vertical polarization antenna, the antenna set 30 can receive the signals. Further, because the antenna set 30 is adapted for space diversity and pattern diversity, it can be employed in the WiFi wireless network card communication system so as to improve the performance of the WiFi wireless network card communication system.

In summary, the antenna according to the embodiment of the present invention, employs a horseshoe configuration, and therefore is adapted to emit/receive wireless signals of vertical polarization direction and horizontal polarization direction. Such an antenna has a lower height than conventional antennae, and can be made of tinplate which is cheap. Further, the antenna set provided by the embodiment of the present invention employs three antennae disposed on a substrate, having characteristics of polarization diversity, pattern diversity, and space diversity. As such, the antenna set has a better performance, a lower cost, and a lower antenna height than the conventional antenna set.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna set, comprising:

three antennas, each comprising:

a first rectangular sheet member, made of a metal material;

a horseshoe sheet member, made of a metal material, having an opening end and a closing end, wherein the opening end is configured with two branches, one of which being connected with the first rectangular sheet member, and the closing end is configured with a signal connection terminal, wherein a plane where the horseshoe sheet member is located is substantially perpendicular with a plane where the first rectangular sheet member is located; and a second rectangular sheet member, made of a metal material, and having a top and a bottom side, wherein the top of the second rectangular sheet member is connected with the first rectangular sheet member, the bottom side of the second rectangular sheet member is configured with a ground connection terminal, wherein a direction extending from the bottom side to the top of the second rectangular sheet member is substantially equivalent with a direction of the opening of the horseshoe sheet member, and a plane where the second rectangular sheet member is located is substantially perpendicular with the plane where the first rectangular sheet member is located, and is substantially parallel with the plane where the horseshoe sheet member is located; and a substrate, on which the three antennae are disposed, wherein the plane where the horseshoe sheet member of the first antenna is located is substantially perpendicular with the plane where the horseshoe sheet member of the third antenna is located, and the plane where the horseshoe sheet member of the second antenna is located substantially configures an angle of 45° with the plane where the horseshoe sheet member of the first antenna is located.

2. The antenna set according to claim 1, wherein the substrate comprises three microstrip lines coupled to the signal connection terminals respectively and adapted for allowing wireless signals to be fed in the antennae, and the ground connection terminal of each of the second rectangular sheet members of the antenna is connected to a ground.

3. The antenna set according to claim 1, wherein the first and the third antennae are received antennas, and the second antenna is an emitted antenna.

4. The antenna set according to claim 1, wherein the substrate is made of a glass fiber material.

5. The antenna set according to claim 1, wherein each of the antennas has a first resonant frequency, and a second resonant frequency.

6. The antenna set according to claim 5, wherein each of the antennas achieves a wider frequency bandwidth in accordance with resonant frequency ranges of the first resonant frequency and the second resonant frequency.

7. The antenna set according to claim 5, wherein each of the horseshoe sheet members is composed of a third rectangular sheet member, a fourth rectangular sheet member, and a fifth rectangular sheet member, the third, fourth and fifth rectangular sheet members are connected together, wherein the third and the fifth rectangular sheet members configure the two branches of the horseshoe sheet member, respectively, the fifth rectangular sheet member is connected to the first rectangular sheet member, and the fourth rectangular sheet member is connected between the third rectangular sheet member and the fifth rectangular sheet member.

8. The antenna set according to claim 7, wherein lengths of the second, the third, the fourth, and the fifth rectangular sheet members are correspondingly related to the first resonant frequency, and lengths of the first, the second, and the fifth rectangular sheet members are correspondingly related to the second resonant frequency.

9. The antenna set according to claim 1, wherein the branch of the opening end of the horseshoe sheet member of each antenna is connected with one side edge of the first rectangular sheet member, and the second rectangular sheet member is connected with another side edge of the first rectangular sheet member.

10. The antenna set according to claim 1, wherein the first rectangular sheet member, the second rectangular sheet member, and the horseshoe sheet member of each antenna are made of tinplate or copper.

* * * * *